United States Patent [19]

Clarke

[11] Patent Number: 4,765,103

[45] Date of Patent: Aug. 23, 1988

[54] BUILDING STRUCTURE AND COMPONENTS THEREOF

[76] Inventor: Neville Clarke, 4/481 Princes Highway, Narre Warren, Victoria 3805, Australia

[21] Appl. No.: 91,297

[22] Filed: Aug. 27, 1987

Related U.S. Application Data

[63] Continuation of Ser. No. 840,559, filed as PCT AU85/00139 on Jun. 25, 1985, published as WO86/00360 on Jan. 16, 1986, abandoned.

[30] Foreign Application Priority Data

Jun. 25, 1984 [AU] Australia ..... PG5665

[51] Int. Cl.[4] ..... E04B 1/32; E04B 1/54; E04C 1/30

[52] U.S. Cl. ..... 52/86; 52/595; 52/604

[58] Field of Search ..... 52/82, 86, 136, 530, 52/588, 595, 603, 604

[56] References Cited

U.S. PATENT DOCUMENTS 3,119,473 1/1964 Mitchell ..... 52/530
3,464,168 9/1969 Russell et al. ..... 52/86 X
3,990,198 11/1976 Ortutay ..... 52/136
4,593,513 6/1986 Stratton ..... 52/604

FOREIGN PATENT DOCUMENTS 592606 9/1947 United Kingdom ..... 52/595

*Primary Examiner*—J. Karl Bell
*Attorney, Agent, or Firm*—Michael, Best & Friedrich

[57] ABSTRACT

A generally self-supporting structure made from a number of interlocking components which can be assembled together, and optionally if desired disassembled. The structure may vary in size from quite small playthings for young children to very large buildings. The structure, in one form, is composed of wall elements alternatively arranged with interlocking elements on either side continuously around the periphery of the structure. The wall elements are provided with a first part of a generally curved engaging means which engagingly interlock with a complementary second part of the engaging means provided on the interlocking elements so as to securely locate the two elements together and permit slight relative movement. The engaging means is characterized by being substantially curved whereas at least one edge of side of each element is rectilinear.

24 Claims, 7 Drawing Sheets

BUILDING STRUCTURE AND COMPONENTS THEREOF

This is a continuation of co-pending application Ser. No. 840,559, filed as PCT Au 85/00139 on Jun. 25, 1985, published as WO 86/00360 on Jan. 16, 1986, now abandoned.

The present invention relates generally to self-supporting structures comprised of a plurality of interlocking component pieces. The structures may be of any size from quite small playthings for children such as for example puzzles, construction toys or the like, up to quite large buildings such as for example buildings useful as dormitories for a multitude of people. One example of the structure is a building of the type that can be manufactured at one location, transported in pieces or in modules to a location remote from its place of manufacture, and erected or assembled on-site.

One example of the application for the structures of the present invention is in providing temporary accommodation for people such as, as holiday houses, building- or work-offices and crew-quarters in remote locations, cabins in the bush, woods or similar, on-site cabins in camping or caravan parks or in providing low-cost housing on a permanent or semi-permanent basis such as in developing countries, or as special accommodation in times of civil strife or as a result of natural catastrophes such as floods, fires, earth-qua]esk or the like. Another application is for stadiums, sports centres, gymnasiums, covers for sporting arenas, playing fields and the like.

In addition, the building structure of the present invention may be used as a sun, a swimming pool cover, a spa bath cover, a studio or as a bungalow. Small versions of the buildings in accordance with the present invention may be used as playthings for children, or as educational aids such as in aiding co-ordination development, or the like.

It is an aim of the present invention to provide self-supporting structures comprised of a plurality of component pieces which alleviate some of the problems associated with similar existing structures.

According to one aspect of the present invention there is provided a component piece suitable for use in constructing a generally self-supporting structure comprising a body portion having at least one substantially rectilinear side or edge provided with a substantially curved engaging means for engaging a complementary engaging means of another component in use.

According to another aspect of the present invention there is provided a generally self-supporting structure capable of being constructed from a plurality of components of the type described herein one of said components being a wall element and another of said elements being an interconnecting element, said wall element capable of being arranged between two or more interconnecting elements and the interconnecting element capable of being arranged between two or more wall elements.

One form of the structure constructable in accordance with the present invention is dome-like in configuration whereas another form of the structure is substantially spherical. However, it is to be noted that the structure of the present invention may take any shape or configuration. The wall elements and the interconnecting elements forming the structure of the present invention provide a substantial amount of the support for the structure since the wall portion formed from both of these elements is the periphery of the structure.

One form of the wall element of the present invention is a substantially planar wall element having engaging means located on a first pair of opposed edges and cooperating means located on a second pair of opposed edges, at least one of the engaging means or of the cooperating means being generally arcuate or curved.

In one embodiment the engaging means of the wall element is capable of engaging with complementary engaging means of an interconnecting element, so that in use the wall element is interconnectable between two adjacent similar interconnecting members.

In another embodiment the cooperating means of a first wall member is complementary to cooperating means of a similar second wall member when the two wall elements are in side by side relationship with the said co-operating means abutting.

Generally, a wall portion is formed by a plurality of similar wall elements being positioned in side by side relationship with their cooperating means abutting.

In another form, each wall element has a pair of engaging means, one of the pair of engaging means being located at one end and the other of the pair located at the opposed end, and a pair of cooperating means, one of the cooperating means located at one side and the other of the cooperating means located at the opposed side. However, it is to be noted that the wall element may be provided at both ends with the same part of the engaging means and the interconnecting element may be provided at both sides with the other part of the engaging means.

In one form, the wall element is substantially planar and substantially rectilinear in shape or profile. Preferably, the sides of the wall element are relatively longer and the ends of the wall member are relatively shorter. In another form the engaging means are located on both short ends and the cooperating means are located on both the long sides.

In one form the cooperating means is a "knuckle joint" arrangement comprising a first portion of a substantially convex curved portion and a second portion of a substantially concave curved portion of complementary arrangement so that the convex portion is received in the concave portion to permit relative pivotal movement of one to the other. Preferably, the upper and lower sides or edges of the wall elements in use are respectively convexly and complementary concavely curved.

In another form, the engaging means are complementary male and female members, said male member being slidably received in said female member so that the interlocking member and wall member may not be separated when pulled in the same plane in a direction so as to pull them apart.

Typically, both of the opposed sides of the interconnecting element are provided with similar arcuate grooves whereas both ends of the wall element are provided with male projections complementary to the arcuate grooves. One form of the arcuate groove is curved in cross-section whereas another form of the groove is shaped to receive a substantially dove-tailed or dove-tail-like projection when viewed from one end of the element.

Typically, the engaging means of the wall element is a dove-tail-like tongue arrangement or a cylindrical core arrangement connected to the member by a web portion of very much reduced thickness compared to the core.

In another form of the invention, when the interlocking member and wall member are securely fastened together such as the core being slidably received in the correspondingly shaped groove, they may not be separated apart from each other by opposed pulling forces even though there is a loose fit or gaps between the respective members.

Typically, the interconnecting element is provided with an arcuate groove lengthwise extending along one side of the element which is the longer side in use. Typically, at least a portion of the respective side edges of the inner or interior of the groove are spaced apart from each other to a greater extent than the exterior edges of the groove along the side surface of the interconnection elements In one form of the present invention, the interconnecting member or rib comprises a plurality of similar elongate interconnecting elements which are capable of being collectively positioned in end to end engagement with each other. Typically, each interconnecting element in use is located between a pair of adjacent wall elements in use, said interconnecting elements and said wall elements in use defining a staggered or off-set pattern in which the join between adjacent interconnecting elements when positioned in end to end relationship does not occur in alignment with the join between adjacent wall elements when positioned one above the other. In another form, when the interconnecting elements are arranged in end to end engagement one above the other in abutting relationship, they form a rib arrangement extending along the side of the structure in use.

In another form the staggered pattern is similar to the stretcher pattern in a brick wall in which the join between two interconnecting elements when placed one above the other occurs substantially in the middle of the wall member at either end of the interconnecting member and the join between two adjacent wall members placed in edge to edge relationship to each other, one above the other, occurs substantially in the middle of the interconnecting elements positioned at either end of the wall members.

In another form of the present invention the structure when assembled is such that substantially all of the joins are staggered from adjacent joins such that there is no straight line of join in a horizontal plane that extends beyond a wall panel or a rib.

In one form, the building structure is substantially dome-like in shape and comprises alternate wall panels and ribs arranged to form the peripheral walls of the structure, said walls being substantially arcuate in shape in the vertical direction so that at or near ground level the distance between opposed portions of the wall is less than the corresponding distance between the same opposed portions at waist level of the building, and the corresponding distance between the same opposed portions gradually decreases from the maxima at waist level to a minimum distance at the top of the dome as the height of the dome increases from waist level to the top of the dome.

Typically, the degree of curvature of the arcuate grooves corresponds to the degree of curvature of the building structure when assembled.

In another embodiment the building structure may take a substantially spherical form or the dome may be any fraction of a complete dome such as for example a ⅓ dome, a ½ dome, an ⅛ dome or the like. Other forms include a rectilinear or pyramidal form or any other suitable geometrical shape or configuration.

The present invention is further described by way of example with reference to the accompanying drawings in which.

Figure 1:
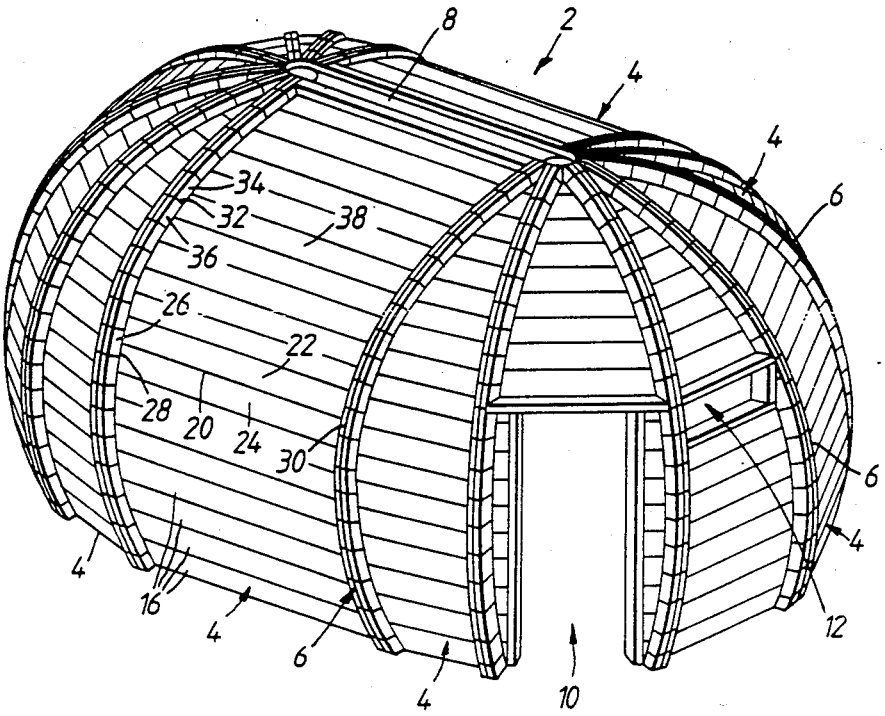
FIG. 1 is a perspective view of one embodiment of a modular building structure assembled from interlocking parts in accordance with the present invention.

In FIG. 1 there is shown a dome-like wooden building structure 2 having fourteen separate wall panels 4 forming the wall sections and fourteen separate ribs 6 comprising interconnecting elements, arranged alternately around the periphery of the structure so as to define the walls of the structure. Each of the fourteen wall panels 4 is located intermediate two ribs 6 and each rib 6 is located intermediate two wall panels 4. It is to be noted that any number of wall panels such as for example 16, 14 or 12 may be assembled, and that the floor area defined by the wall panels may be of any suitable or desired size. A wooden cap 8 is located at the top of the structure to form its roof. It is to be noted that the wooden cap may be replaced by other features which serve the same purpose to act as a keystone for the assembled building, such as a ring member. A doorway 10 and a window frame 12 are located in respective adjacent wall panels. Although a single doorway and a single window frame are illustrated it is possible that any number of additional doorways or window frames may be located in any of the wall panels. However, in the embodiment illustrated only one of either the doorway of a window frame may be placed in any one wall panel. The doorway and the window frame are made from timber. Optionally, ventilation apertures may be included in the assembled structure either as alternatives to or additional to the windows. The wall panels 4 may be of any suitable or desirable length and ribs 6 may be of any suitable or desirable width. It is to be noted that any suitable form of cap 8 may be used to provide support for the assembled structure in a manner similar to the key stone of an arch or to provide a cover for the top of the building structure.

Each wall panel 4 includes a plurality of wooden slats 16 or wall elements forming the wall members Slats 16 are elongate substantially planar quadrilateral lengths of timber, arranged elongate edge to elongate edge on their sides one on top of the other to define the wall panel. In FIG. 1, nineteen slats are shown as forming a single wall panel whereas in other embodiments (not shown) there may be other numbers of separate slats forming a single wall panel. Any number of slats 16 may constitute a panel depending on the width of the slats being used to form that panel. The slat will be described in more detail later.

Each rib 6 includes a plurality of wooden blocks 18 forming the interconnection elements for interconnecting adjacent panels to each other by the wooden blocks engaging with the wooden slats located beside them. Blocks 18 are arranged one on top of each other in end to end relationship to form the rib in a manner such that the lower end of an upper block rests on top of or on the upper end of the lower block. In this manner a plurality of blocks placed end to end form a substantially arcuate rib extending from ground level to the top of the structure since, in one embodiment the end faces of a single block are not parallel but rather form two planes which are arranged at an angle to each other. In FIG. 1, twenty separate blocks are shown as forming each rib. However, it is to be noted that any number of blocks may be used depending on the width of the slats forming the corresponding wall panels. In another embodiment the upper and lower surfaces of the blocks may be complementary concave and convex in shape.

It is to be noted that the slats and blocks may be loosely fitted together during construction and that there may be gaps between respective joined ends of the slats and blocks, and the engaging means permitting interlocking of the components is such that the slats and blocks may not be pulled apart from each other during construction.

It is noted from a study of FIG. 1 that the join 20, between two adjacent slats 22, 24 when one is placed on the other, is located about the middle 26 of the blocks 28, 30 positioned at the respective ends of the slats 22, 24, and the join 32, located between two adjacent blocks 34, 36, when one is placed on the other occurs about the middle of slat 38 located next to the two blocks 34, 36.

The arrangement of joins between adjacent slats and joins between adjacent blocks when viewed from the side of the building has a similar appearance as a brick wall laid in a stretcher pattern when viewed at right angles to the face of the bricks forming the wall. The arrangement of alternate blocks and slats contributes to the structural rigidity of the building structure and allows the building to be assembled by placing a first set of two blocks at spaced locations and placing a first slat between the blocks, the length of the slat corresponding to the distance the two blocks are apart, then placing a second set of blocks on the first set of blocks so that respective ones of each set are together and respective others of the two sets are together. A second slat is placed between the second set of blocks and so on with the subsequent slats and sets of blocks. It is to be noted that in one form of the invention a slat is first placed on the floor surface and a first pair of blocks assembled onto the slat, one at either end, then a second slat is positioned and a second set of blocks and so on in sequence. To facilitate building of the dome-like structure more than a single wall panel may be assembled at a time. Since the rigidity of the structure depends on the interlocking of the wall members and interconnecting elements, it is preferable that all parts of the periphery of the structure be assembled simultaneously.

Turning now to FIGS. 2 to 7, the interconnecting element and wall member will be described in more detail.

Figure 2:
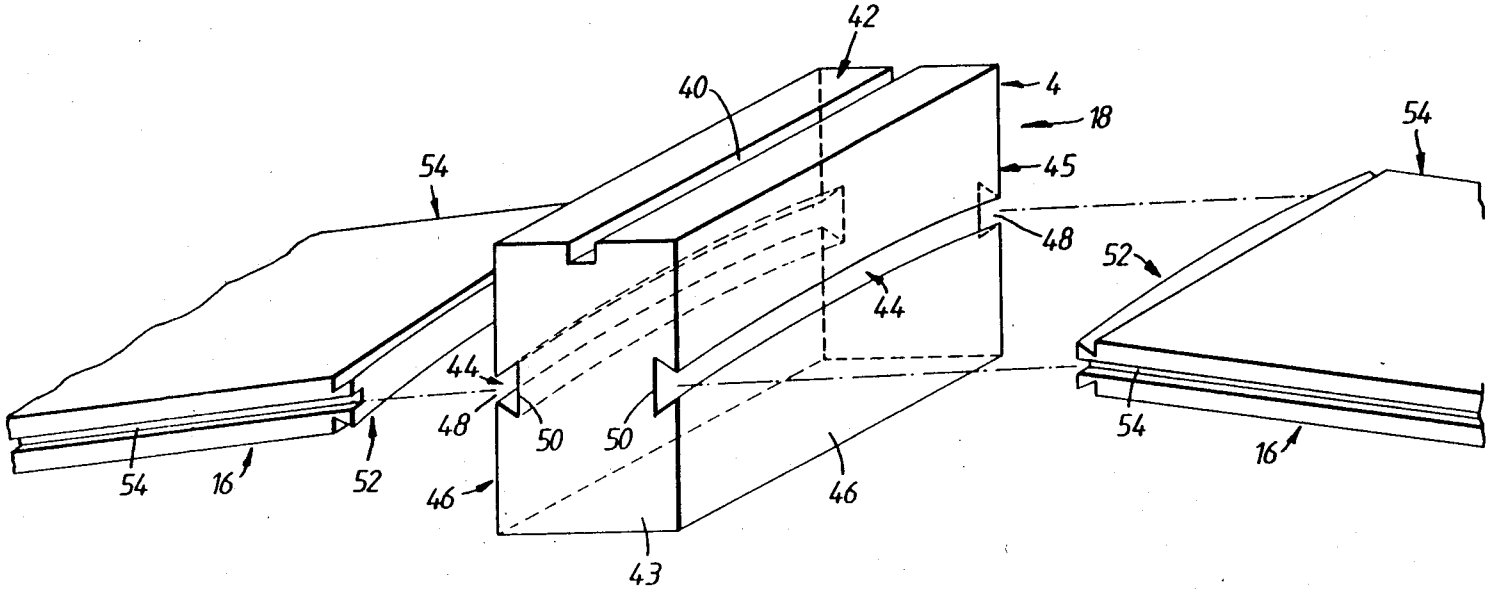
FIG. 2 is an exploded perspective view of an embodiment of an interconnecting element of the present invention, together with two examples of the form of the wall elements showing how the wall elements interlock with the interconnecting element.

In FIG. 2, an embodiment of the interconnecting element in the form of a block 18 is shown with two adjacent wall members in the form of slats 16. Block 18 and slats 16 are similar to the block 18 and slats 16 used in the assembling structure 2 of FIG. 1.

A straight recess 40 which is parallel to the side edges of block 18 extends lengthwise along one face 42 of the block for receiving a support wire or rod or similar cable like element (not shown) in use to rigidify the dome since the support wire is secured at one end to cap 8 at the top of the structure, (to be described in more detail later) extends along the collective recesses 40 of the blocks when in end to end relationship outside the structure, and is secured to the ground at the other end or to the floor of the building structure which may extend beyond the wall panels. Thus, the blocks are all securely locked in place by the support wire. It is to be noted that the support wire or rod may itself be modular having complementary male and female ends so that long lengths of the wire may be assembled by joining a plurality of identical. sections together in end to end relationship. Another embodiment has a plurality of first wire sections with identical engaging means at both ends and a plurality of second wire sections having the same engaging means at both ends. The engaging means of the first portion being complementary to the engaging portions of the second portion. However, it is to be noted that the support wire is an optional feature since the blocks will maintain their rigid end to end relationship without the need for the additional support supplied by the support wire. The face 42 of the block in which the support wire is located is the outer face of the block in use.

The end faces 43, 45 of block 18 are not parallel to each other but rather form convergent planes so that when a plurality of similar blocks 18 are stacked one upon the other the blocks form an arcuate rib.

Block 18 has arcuate grooves 44 extending lengthwise down both side faces 46 for the entire length of the block. The side faces of the block are the side faces which are adjacent to the wall members in use in the structure of the present invention. The shape of the grooves is such that the dimension of the width of the opening 48 of the groove is less than the corresponding dimension of the interior 50 of the groove such that when a complementary shaped projection 52 is slidably received in the groove by sliding the projection lengthwise it may not pull free in the direction generally perpendicular to side faces 46. Preferably the slats and blocks are losely fitted together prior to tensioning.

The complementary projection 52 which is formed at both ends of slat 16 corresponds to arcuate grooves 44 in shape although the slats 16 themselves are substantially. planar Arcuate projection 52 extends the entire width of the slat and is thicker at the free end than where it joins slat 16. Cooperating means 48 in the form of a tongue and groove arrangement 54 is provided along the lengthwise extending edges of slat 16. The tongue and groove arrangement is located along the upper and lower faces of the slat in use in a building structure of the present invention such that one of either the tongue or groove of an upper slat cooperates with the other of the tongue or groove of a lower slat as so on for each pair of slats. The tongue and groove arrangement facilitates the rigidity of the structure when assembled since the slats interlock with each other as well as with the blocks located at either end. The tongue of a first slat cooperates with a second slat located below the first slat.

Figure 3:
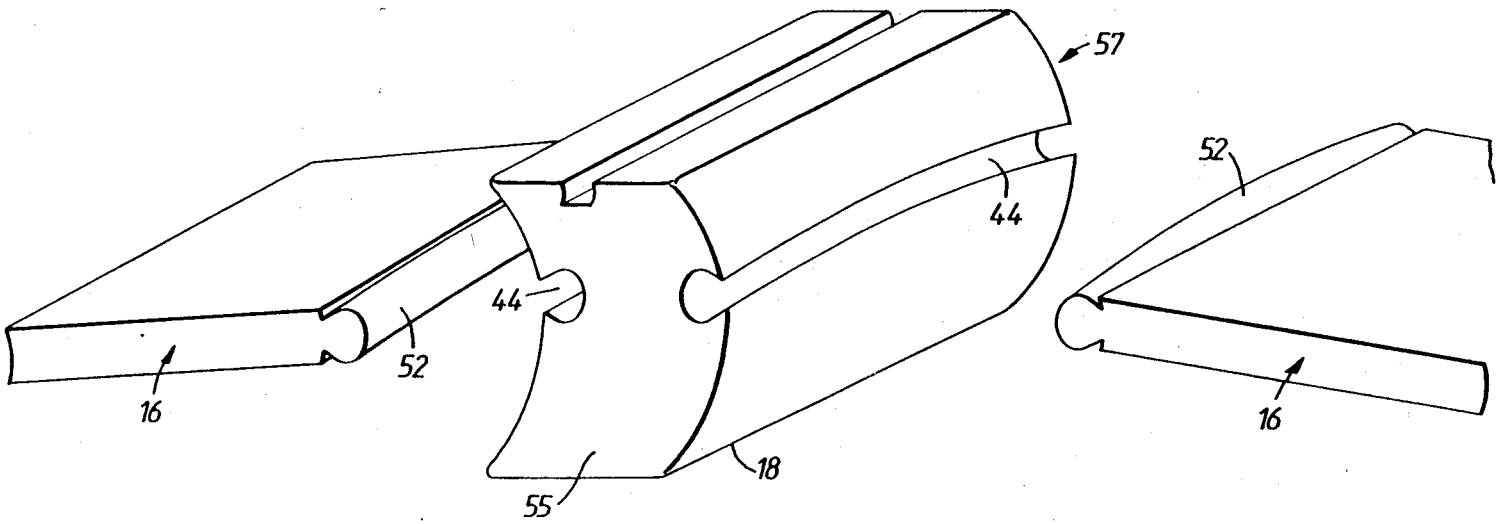
FIG. 3 is a similar view to FIG. 2 showing an alternative embodiment of the interconnecting element.
Figure 4:
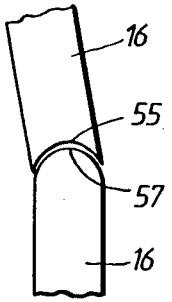
FIG. 4 is a partial cross-section view of two adjacent wall elements in abutting relationship one above the other.
Figure 5:
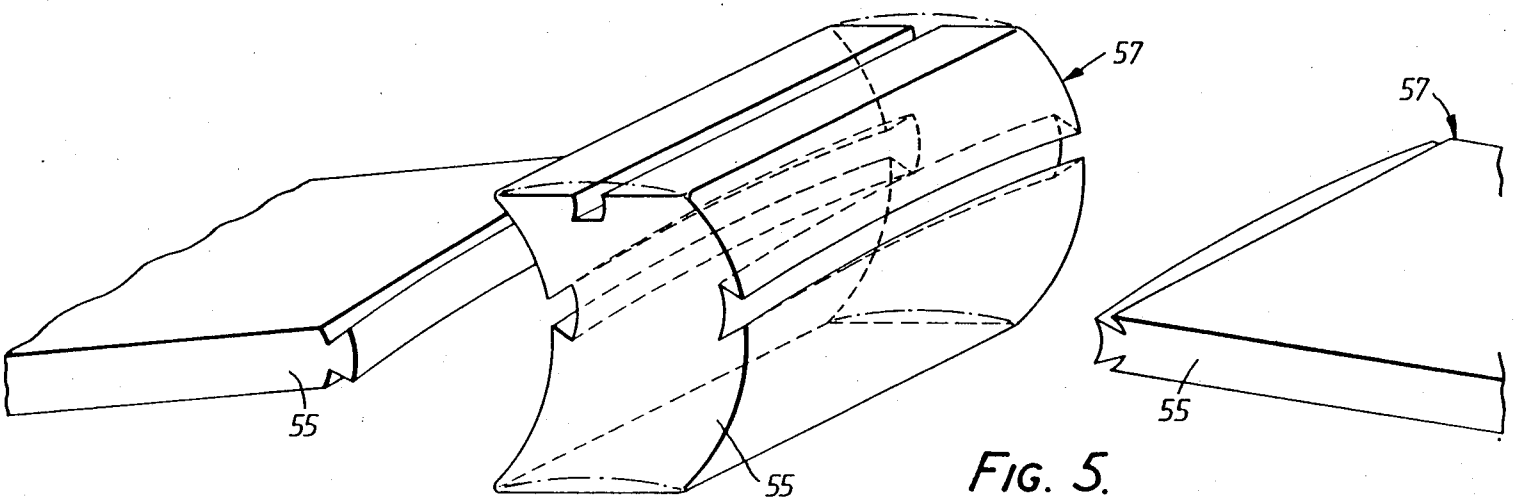
FIG. 5 is a perspective view of a further embodiment of the interconnecting element.

In FIG. 3, an alternate form of the cooperating means is shown which includes two corresponding curved surfaces 55, 57, located along the lengthwise extending edges of slot 16, arranged so as to be engagable with each other to form a "knuckle joint" comprising complementary convex and concave curved surfaces which abut one another to permit pivotal movement of one slat relative to the other slat yet maintain intimate contact. The "knuckle joint" allows the slats to be positioned relative to each other at an angle as shown in FIG. 4, yet provide cooperation between the two slats to facilitate structural rigidity and provide other advantages such as water proofing the wall panels.

Figure 6:
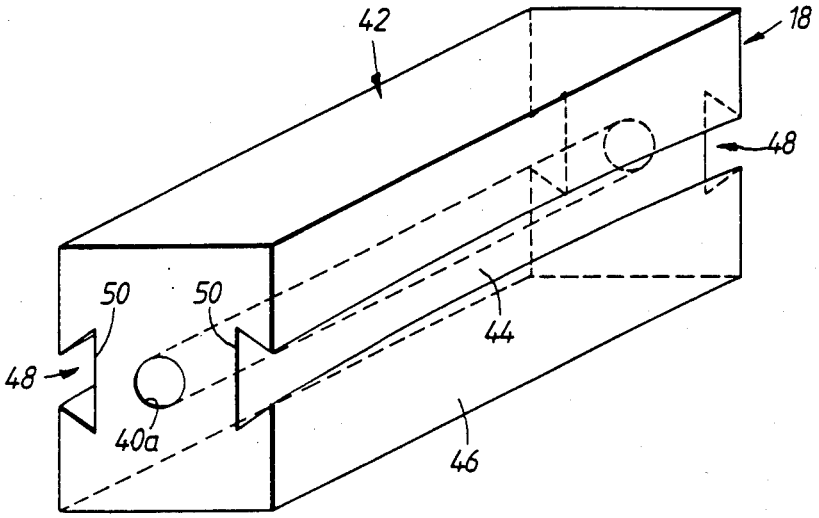
FIG. 6 is a perspective view of a further embodiment of the interconnecting element and wall element.
Figure 7:
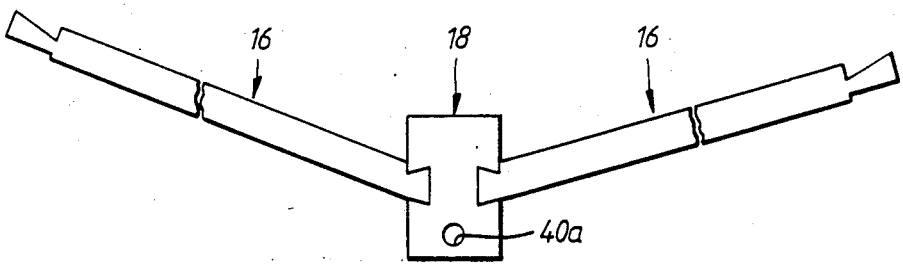
FIG. 7 is a cross-section view of an interconnecting element and two adjacent wall members interlocked together.

In FIG. 6 which shows an alternative means of tensioning than shown in FIG. 2 there is shown an elongate cylindrical bore 40a through block 18. Bore 40a extends from one end of block 18 to the other end and is located between the centre line of the block and its outer edge in use along the median plane of the block. Similarly, a support wire as described above may pass through the collective bores 40a of the blocks 18 when located in end to end relationship to secure the building structure even further than the rigidity applied by the interconnection of the various components supplied. It is to be noted that the support wire in one embodiment may provide substantially all of the structural rigidity of the building, yet in another embodiment may only contribute to the rigidity, the remainder being provided by the engagement means of the interconnecting element. In the embodiment of the block 18 shown in FIG. 6 it is to be noted that the support wire is not visible along the length of the walls of the building from either outside or inside the building when assembled as it is hidden inside blocks 18.

It is to be noted that any form of engagement means between interconnecting elements and the wall means which allow interlocking of the plurality of wall members and the plurality of interconnecting elements to form a rigid building structure, such as for example one having a dome-like configuration assembled from a plurality of components is within the scope of the present invention.

Further, it is to be noted that in the building structure of the present invention the ends of the wall members may abut the ends of other wall members such that the interlocking elements are not located between adjacent wall members thus separating them, but rather may be located behind or in front of the wall members. Thus, the wall members in the form of slats may be in abutting relationship with each other or may be spaced from each other with the interconnecting means located between them.

Figure 8:
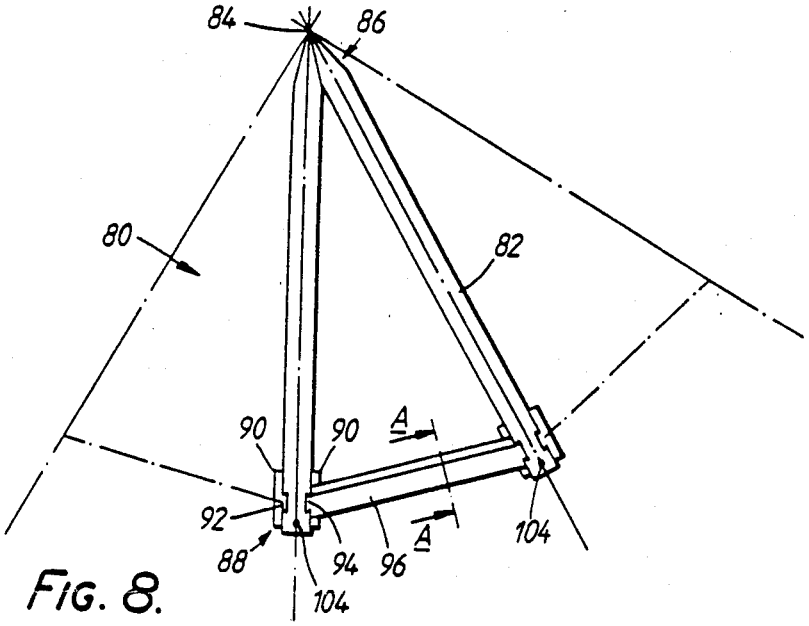
FIG. 8 is a plan view of a part of one form of the flooring and floor support arrangement of the structure of the present invention.
Figure 9:
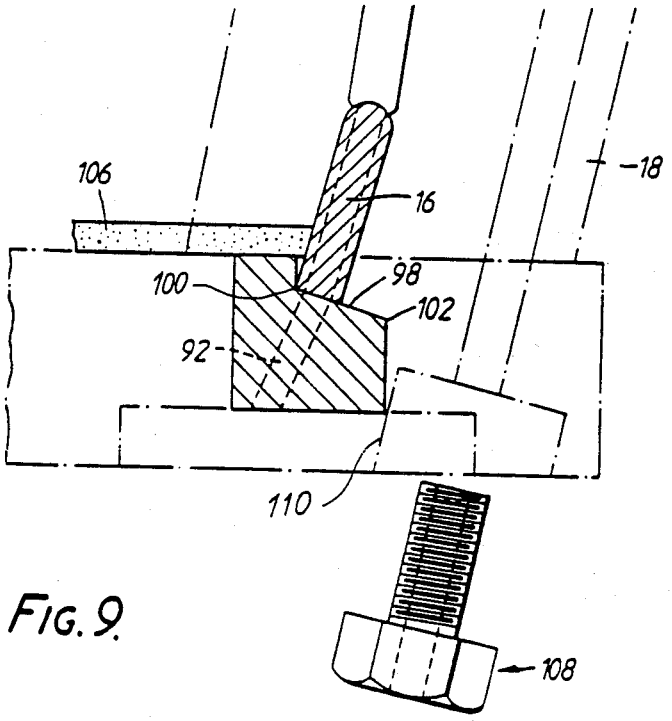
FIG. 9 is a sectional view along the line A to A of FIG. 8.

Another aspect of the present invention is concerned with a floor arrangement for supporting the structure cf the present invention when used as a building. In FIG. 8, there is shown a partial view of one form of the floor support arrangement generally denoted as 80, comprising a number of radially arranged spokes 82 emanating from a central point 84 to extend to the perimeter of the building structure. Each spoke is provided with a pointed angularly inclined inboard or proximal end 86 for abutting against two similarly shaped ends so as to be capable of being arranged in side by side relationship. The outboard or distal end 88 of the spoke is provided with a pair of joist supports 90, located on either side of the spoke for supporting the joist in use and is provided with a substantially arcuate groove 92 on either side immediately above the joist supports for receiving the complementary shaped projection 94 of a joist 96. One such joist 96 having projections 94 at either end interconnects two adjacent spokes 82 having arcuate grooves 92. Joist 96 is provided with a shoulder or rebate 98 along its upper edge in use such that the inboard edge 100 of the shoulder is slightly higher in use than the outboard edge 102 which results in the rebate sloping downwards and outwards as shown in FIG. 9. Flooring 106 is located on the collective spokes 82 and joists 96 and slats 16 rests upon rebate 98 in use such that the distal edge of the flooring 106 abuts against the interior surface of slat 16. A block 18 is located at either end of slat 16 as previously described.

Bore 104 which is located at the distal end of spoke 82 for receiving a support wire 124 or similar is provided with a counter bore 110 for receiving the head of an internally threaded bolt 108 into which the end of the support wire is received and firmly attached thereto. The shaft of bolt 108 is received in bore 104.

Figure 10:
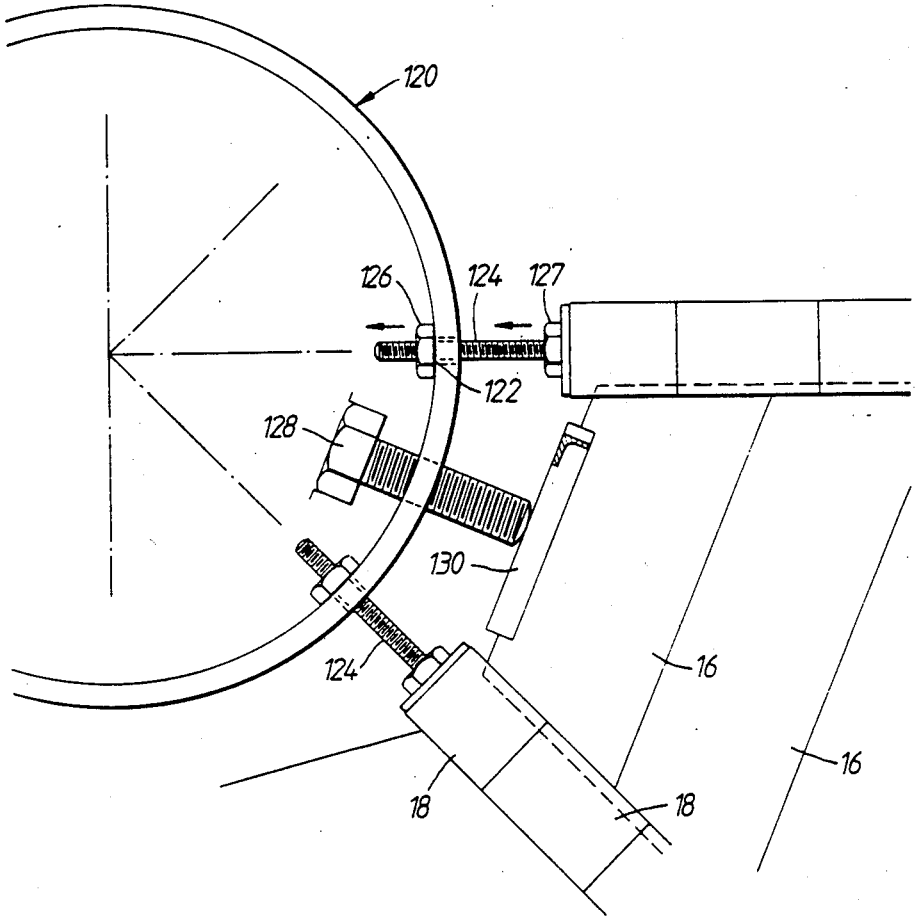
FIG. 10 is a plan view of part of one form of the top portion of a building structure made in accordance with the present invention.

Another aspect of the present invention concerns the method and apparatus for post tensioning the building structure when assembled. In one form of this aspect of the invention, shown in FIG. 10 there is provided a ring 120 which is located at the top of the building structure in use. Ring 120 is provided with a plurality of apertures 122 spaced at regular intervals around the ring for receiving the ends of the support wire 124. Support wire 124 is provided with an externally threaded portion at its end for receiving a nut 126 and also a nut and washer arrangement 127 which is located against the free end of the uppermost support block 18 of each rib. Bolts 128 are also located at spaced apart intervals around ring 120 alternately with apertures 122 such that each bolt 128 bears against a bearing surface 130 located at the top of each wall panel. Bearing surface 130 is provided along the upper edge of the topmost slat 16 of each panel.

In operation, after all of the interconnecting components, including all of the slats and blocks have been loosely assembled, and all the support wires 124 have been received in apertures 122, the nut and washer arrangements 127 are tightened to tension the ribs of blocks 18 to rigidify the building structure. Then, nuts 126 are collectively tightened to complete the tensioning of the blocks 18 in the ribs and to provide integrity for the building structure with respect to the diagonally opposed ribs. Then, using bolt 128 each wall panel is tensioned by compressing all of the slats 16 together about the respective cooperating means located along the respective upper and lower edges of the pairs of slats. Thus, the entire structure is now under tension.

One of the advantages of the present invention is that when there is no further use for the building it can be easily dismantled into its separate modules for transportation to a further location and assembled there, or it can be stored until it is required for use at a later date.

Another advantage of the present invention over previously available buildings of the prior art is in the utilisation in the present invention of discarded materials such as off-cuts of timber used in building conventional houses as the raw material from which the various components or modules may be cut, particularly the utilisation of off-cuts from the timber flooring used in such houses.

A further advantage is that no separate framework is required to provide support for the building when it is being assembled and when fully assembled. The building at all stages in its assembly and when fully assembled is self-supporting. Since the building requires no framework, the cost is further reduced.

The described arrangement has been advanced merely by way of explanation and many modifications may be made thereto.

One such modification is that a building in accordance with the present invention may include more than a single dome, all such domes interconnected so as to form a house of a number of rooms. The separate domes may share a common wall or may have a passageway interconnecting them.

A further modification is the provision of a verandah extending from the wall panels either part way around the building structure or totally around its periphery. The verandah is attached to the building structure by elongate members suitably shaped at their ends to substitute for blocks where appropriate such that the ends of the members interlock with the wall panels.

A further modification is to provide a building structure in accordance with the present invention having a cavity wall formed by two domes arranged one inside the other by means of one being slightly smaller than the other. In this modification, the interconnecting member has two interconnecting means so that one face of a single block has two arcuate slots spaced from each other on it so that a single block may interconnect two domes simultaneously i.e. provide interconnection means for 4 wall sections. The cavity formed by the two walls may then be used for the provision of normal services for a domestic dwelling such as water, electricity, gas, insulation and the like.

A further modification is the deletion of one or more wall panels or sections from the building structure which does not adversely effect the rigidity of the building structure, thus providing a shade shelter or open shelter arrangement.

A further modification is that the dove-tails or grooves 44 located on the sides of blocks 18 may also be provided with additional grooves recessed into the inner surface of the dovetail. The recessed grooves are arranged to be substantially parallel to the dove-tailed grooves 44 i.e. they are generally arcuate in shape for receiving a support wire or tensioning line. The support wire may the be located along the centre line of the dove-tails to tension the building structure and thus, no support wire is visible from either inside or outside the building along the length of the wall panels or sections.

These and other modifications may be made without departing from the spirit and scope of the invention which includes every novel feature and combination of novel features herein disclosed.

I claim:

1. A component piece suitable for use in constructing a generally self-supporting structure, the component piece comprising a body having at least a first substantially rectilinear side, the first substantially rectilinear side including a surface having at least one substantially curved engaging means, the curved engaging means having opposite ends and extending across the surface of the first rectilinear side, and the engaging means being non-linear in the direction extending from one of its opposite ends to the other of its opposite ends, said engaging means being provided for interlocking by engaging with a complementary engaging means of another component piece in use.

2. A component piece according to claim 1, wherein the first substantially rectilinear side includes opposite side edges and wherein the curve of the substantially curved engaging means is such that the mid portion of the substantially curved engaging means is spaced apart from one of the opposite side edges to a lesser amount than are the respective ends of the curved engaging means.

3. A component piece according to claim 2 in which the body is provided with at least two substantially curved engaging means.

4. A component piece according to claim 3 in which the at least two substantially curved engaging means are substantially identical to each other being either female grooved portions or being male projecting portions.

5. A component piece according to claim 4 in which the body is substanttially of a quadrilateral form having at least one pair of opposed faces which are planar and the at least two engaging means are located in or along the opposed planar faces, one of the planar faces being the first edge or side and the other planar face being a second rectilinear edge or side.

6. A component piece according to claim 3 in which the at least two substantially curved engaging means are substantially complementary to each other such that one of the engaging means is a female grooved portion and another of the engaging means is a male projecting portion.

7. A component piece according to claim 5 in which the male projecting portion of the engaging means comprises an enlarged head portion connected to the body by a neck portion having a reduced thickness relative to the head portion and the female grooved portion of the engaging means comprises an open channel or groove complementary in shape to the enlarged head portion of the male engaging portion, said open channel or groove being arranged such that the opening of the channel portion is located in the surface of one face of the body and the channel is located inboard with respect to the opening whereby the enalrged head portion of one component piece is slidably receivable within the channel of another component piece in use so as to interlockingly engage the two component pieces together with the neck portion being alinged with the opening of the channel.

8. A component piece according to claim 7 in which the enlarged head portion and neck portion comprises a dove-tail arrangement or dove-tail like arrangement or the head portion is of a substantially circular cross-section.

9. A component piece according to claim 5 in which the body is of a substantially right parallelepipidal form and has a pair of relatively long sides and the female portions of the engaging means are located along the long sides.

10. A component piece according to claim 5 in which the body is of a substantially right parallelpiepidal form and has a pair of relatively short ends and the male portions of the engaging means are located along the short ends.

11. A component piece according to calim 3 further comprising co-operating means which are provided on sides or edges of the body other than the sides or edges having the engaging means.

12. A component piece according to claim 11 in which the co-operating means comprises a first part and a second part, said first part being complementary to said second part, wherein the component piece has at least two substantially identical first parts, or two substantially identical second parts or has a first part and complementary a second part.

13. A component piece according to claim 12 in which the co-operating means is such to as to allow relative pivotal movement of a first component piece with respect to a second component piece in use.

14. A component piece according to claim 13 in which the first part of the co-operating means is a substantially convexly curved portion extending substantially along an edge or side of the body and the second part of the co-operating means is a substantially concavely curved portion extending along an edge or side of the body, said convexly curved portion being pivotally movable in said concavely curved portion in use.

15. A component piece according to claim 11 in which the first and second edges or sides are opposed to each other and each is provided with a female channel of substantially circular cross-section having an opening extending lengthwise the body and a third and fourth edge or side are opposed and each has one part of the co-operating means.

16. A component piece according to claim 11 in which the first and second sides or edges are opposed to each other and each is provided with a male projection of subtantially circular cross-section and a third and fourth edge or side are opposed are provided respectively with a concave curved co-operating means and a convex curved co-operating means.

17. A generally self-supporting structure capable of being constructed from a plurality of component pieces according to claim 1, one of said component pieces being a wall element and another of said component pieces being an interconnecting element, said wall element capable of being arranged between two or more interconnecting elements and the interconnecting element capable of being arrangement between two or more wall elements.

18. A structure according to claim 17 in which the join betwen adjacent interconnecting elements when positioned in end to end relationship does not occur in alignment with the join between adjacent wall elements when positioned one above the other in abutting relationship.

19. A structure according to claim 18 arranged so that all of the joins betwene adjacent component pieces are staggered from adjacent joins so that there is no straight line of join in a horizontal plane that extends beyond a single wall and or rib.

20. A structure according to claim 17 in the shape or configuration of a dome or being substantailly dome-like or spherical or part-spherical.

21. A structure according to claim 17 comprising a plurality of interconnecting elements arranged in end to end relationship with their respective co-operating means abutting in co-operation with each other and a plurality of wall elements arrayed in side by side abutting relationship, with their respective co-operating means in co-operation with each other said interconnecting elements being connected to said wall elements by the respective engaging means.

22. A structure according to claim 17 further comprising a flooring arrangement, the flooring arrangement having at least one member provided with engaging means for interlocking interconnection to a component piece.

23. A structure according to claim 17 further comprising a tension means located at or towards the upper end of the structure in use so as to apply tension to the structure in the direction corresponding to that of the walls of the structure.

24. A structure according to claim 23 in which the tension means extends from an adjustable anchorage at or towards the top of the structure to a fixed anchorage at or towards the bottom of the structure so as to adjustably compass the component pieces together, said tension means including a flexible member wherein said flexible member is received in a groove or bore provided in selected component pieces to collectively tension said structure.

* * * * *